US012747074B2

(12) United States Patent
Casey et al.

(10) Patent No.: US 12,747,074 B2
(45) **Date of Patent: *Sep. 29, 2026**

(54) CHILD-RESISTANT CONTAINER

(71) Applicant: Altria Client Services LLC, Richmond, VA (US)

(72) Inventors: Brian M. Casey, Richmond, VA (US); James David Evans, Chesterfield, VA (US); David Dawson, Asheboro, NC (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/975,265

(22) Filed: Dec. 10, 2024

(65) Prior Publication Data

US 2025/0100762 A1 Mar. 27, 2025

Related U.S. Application Data

(63) Continuation of application No. 18/060,227, filed on Nov. 30, 2022, now Pat. No. 12,195,247.

(51) Int. Cl.

| | |
|---|---|
| ***B65D 50/06*** | (2006.01) |
| ***B65D 43/02*** | (2006.01) |
| ***B65D 81/32*** | (2006.01) |

(52) U.S. Cl.

CPC ..... *B65D 50/061* (2013.01); *B65D 43/021* (2013.01); *B65D 81/32* (2013.01); *B65D 2215/04* (2013.01); *B65D 2543/0049* (2013.01)

(58) Field of Classification Search

CPC .... B65D 51/28; B65D 50/061; B65D 43/021; B65D 81/32; B65D 2215/04; B65D 2543/0049

See application file for complete search history.

(56) References Cited

U.S. PATENT DOCUMENTS

| | | | |
|---|---|---|---|
| 4,491,238 | A | 1/1985 | Tobolt |
| 5,328,047 | A | 7/1994 | Smith |

(Continued)

FOREIGN PATENT DOCUMENTS

| | | | |
|---|---|---|---|
| EP | 1163169 | A1 | 12/2001 |
| EP | 2236433 | A1 | 10/2010 |

(Continued)

OTHER PUBLICATIONS

International Search Report and Written Opinion dated Feb. 23, 2024 issued in related international patent application No. PCT/US2023/081317.

*Primary Examiner* — Shawn M Braden

(74) *Attorney, Agent, or Firm* — HARNESS, DICKEY & PIERCE, P.L.C.

(57) ABSTRACT

At least one example embodiment relates to a container. The container includes a base, a canister configured to engage a portion of the base, and a lid configured to be removably coupled to the canister such that the lid is moveable between a locked position and an unlocked position. The base includes a bottom wall having a central portion, a peripheral portion, and an angle portion between the central portion and the peripheral portion. The base includes a first sidewall extending from a periphery of the peripheral portion and about a periphery of the bottom wall and a second sidewall extending from an end of the peripheral portion opposite the first sidewall. The first sidewall and the second sidewall extend perpendicular to the peripheral portion such that the peripheral portion, first sidewall, and second sidewall define a first gap.

20 Claims, 16 Drawing Sheets

(56) References Cited

U.S. PATENT DOCUMENTS

| | | | |
|---|---|---|---|
| D541,176 | S | 4/2007 | Bried |
| D556,037 | S | 11/2007 | D'Amato |
| D559,105 | S | 1/2008 | D'Amato |
| D563,786 | S | 3/2008 | Welk et al. |
| D567,086 | S | 4/2008 | Buchman et al. |
| D567,656 | S | 4/2008 | Neias |
| D581,792 | S | 12/2008 | Krohn |
| D592,956 | S | 5/2009 | Thiellier |
| D599,953 | S | 9/2009 | Gibson et al. |
| D603,698 | S | 11/2009 | VerWeyst |
| D617,941 | S | 6/2010 | Bjorkholm |
| D621,603 | S | 8/2010 | Traylor |
| D625,047 | S | 10/2010 | Gibson et al. |
| D626,687 | S | 11/2010 | Gibson et al. |
| D635,015 | S | 3/2011 | McKenzie |
| D640,545 | S | 6/2011 | Gibson et al. |
| D640,546 | S | 6/2011 | Berggren |
| D644,119 | S | 8/2011 | Giles |
| D650,269 | S | 12/2011 | Berggren |
| D651,519 | S | 1/2012 | Gibson et al. |
| D651,923 | S | 1/2012 | Cronin |
| D653,127 | S | 1/2012 | Cronin et al. |
| D660,693 | S | 5/2012 | Berggren |
| D664,840 | S | 8/2012 | Jones et al. |
| 8,360,235 | B2 | 1/2013 | Gibson |
| D683,497 | S | 5/2013 | Ghiotti et al. |
| D683,498 | S | 5/2013 | Ghiotti et al. |
| D686,513 | S | 7/2013 | Henriksson |
| D703,537 | S | 4/2014 | Vogel et al. |
| D711,232 | S | 8/2014 | Henriksson |
| D711,233 | S | 8/2014 | Henriksson |
| D711,249 | S | 8/2014 | Henriksson |
| D711,250 | S | 8/2014 | Henriksson |
| D711,741 | S | 8/2014 | Humm et al. |
| D711,742 | S | 8/2014 | Humm et al. |
| D711,743 | S | 8/2014 | Humm et al. |
| D711,744 | S | 8/2014 | Humm et al. |
| D711,745 | S | 8/2014 | Humm et al. |
| D711,746 | S | 8/2014 | Humm et al. |
| D712,256 | S | 9/2014 | Humm et al. |
| D712,259 | S | 9/2014 | Humm et al. |
| D712,260 | S | 9/2014 | Humm et al. |
| D712,261 | S | 9/2014 | Humm et al. |
| D712,262 | S | 9/2014 | Humm et al. |
| D712,263 | S | 9/2014 | Humm et al. |
| D712,264 | S | 9/2014 | Humm et al. |
| D713,598 | S | 9/2014 | Ghiotti et al. |
| D719,828 | S | 12/2014 | Henriksson |
| D727,148 | S | 4/2015 | Humm et al. |
| D727,149 | S | 4/2015 | Humm et al. |
| D727,731 | S | 4/2015 | Humm et al. |
| D740,029 | S | 10/2015 | Otto et al. |
| D756,790 | S | 5/2016 | Henriksson |
| D762,475 | S | 8/2016 | Turner et al. |
| D773,302 | S | 12/2016 | Henriksson |
| D783,403 | S | 4/2017 | Sill |
| D802,836 | S | 11/2017 | Ghiotti et al. |
| D803,677 | S | 11/2017 | Yang |
| D804,721 | S | 12/2017 | Ghiotti et al. |
| D814,705 | S | 4/2018 | Norris |
| D837,447 | S | 1/2019 | Aspgren |
| D845,790 | S | 4/2019 | Straughan |
| D851,488 | S | 6/2019 | Tartock et al. |
| D852,647 | S | 7/2019 | Burditt et al. |
| D856,143 | S | 8/2019 | Tartock et al. |
| D860,816 | S | 9/2019 | Rathbun |
| D866,334 | S | 11/2019 | Wieland et al. |
| 10,463,075 | B2 | 11/2019 | Beardsall |
| D871,906 | S | 1/2020 | Ramsey |
| 10,618,707 | B2 | 4/2020 | Straughan |
| D885,919 | S | 6/2020 | Beardsall |
| D887,285 | S | 6/2020 | Straughan |
| D900,619 | S | 11/2020 | Beardsall |
| D905,555 | S | 12/2020 | Öztürk |
| 10,940,981 | B2 | 3/2021 | French et al. |
| 10,940,982 | B1 | 3/2021 | Lei |
| D923,241 | S | 6/2021 | Markovic et al. |
| 11,072,468 | B2 | 7/2021 | Than-Aye |
| D933,481 | S | 10/2021 | Eriksson et al. |
| 11,147,309 | B2 | 10/2021 | Patel et al. |
| 11,160,410 | B2 * | 11/2021 | Roesel, Jr. ..... B65D 81/365 |
| 11,291,237 | B2 | 4/2022 | Rushforth et al. |
| D952,474 | S | 5/2022 | Shimek et al. |
| 11,358,764 | B2 | 6/2022 | Sterling et al. |
| D957,942 | S | 7/2022 | Woolery |
| D958,452 | S | 7/2022 | Söderström et al. |
| 11,440,709 | B2 | 9/2022 | Lei |
| D967,717 | S | 10/2022 | Timmers |
| D1,014,263 | S | 2/2024 | Casey et al. |
| 2016/0073679 | A1 * | 3/2016 | Rushforth ..... A24F 23/00 131/300 |
| 2017/0355495 | A1 | 12/2017 | Martin et al. |
| 2020/0140156 | A1 | 5/2020 | Combs |
| 2020/0148435 | A1 | 5/2020 | Brown et al. |
| 2020/0187696 | A1 * | 6/2020 | Roesel, Jr. ..... A47G 33/08 |
| 2021/0009323 | A1 | 1/2021 | Markarian et al. |
| 2021/0009324 | A1 | 1/2021 | DiGrado |
| 2021/0114783 | A1 | 4/2021 | Sibley et al. |
| 2021/0122539 | A1 | 4/2021 | Martin et al. |
| 2022/0071280 | A1 | 3/2022 | Patel et al. |
| 2022/0104543 | A1 | 4/2022 | Patel et al. |
| 2022/0234796 | A1 | 7/2022 | Martin et al. |
| 2023/0013978 | A1 | 1/2023 | Patel et al. |
| 2023/0329334 | A1 | 10/2023 | Patel et al. |

FOREIGN PATENT DOCUMENTS

| | | | |
|---|---|---|---|
| GB | 1582416 | A | 1/1981 |
| WO | 00/37325 | A1 | 6/2000 |
| WO | D213084-001 | | 9/2021 |
| WO | D213084-002 | | 9/2021 |
| WO | D213084-003 | | 9/2021 |
| WO | D213587-001 | | 9/2021 |
| WO | D217943-001 | | 6/2022 |
| WO | D217943-002 | | 6/2022 |
| WO | D220569-001 | | 7/2022 |
| WO | D220569-002 | | 7/2022 |
| WO | D220569-003 | | 7/2022 |

* cited by examiner

CHILD-RESISTANT CONTAINER

CROSS REFERENCE TO RELATED APPLICATIONS

This application is a continuation of U.S. application Ser. No. 18/060,227, filed Nov. 30, 2022, the entire contents of which is incorporated herein by reference.

BACKGROUND

Field

The present disclosure relates to a child-resistant container.

SUMMARY

At least one example embodiment relates to a container.

In at least one example embodiment, the container includes a base, a canister configured to engage a portion of the base, and a lid configured to be removably coupled to the canister such that the lid is moveable between a locked position and an unlocked position. The base includes a bottom wall having a central portion, a peripheral portion, and an angle portion between the central portion and the peripheral portion. The base includes a first sidewall extending from a periphery of the peripheral portion and about a periphery of the bottom wall and a second sidewall extending from an end of the peripheral portion opposite the first sidewall. The first sidewall and the second sidewall extend perpendicular to the peripheral portion such that the peripheral portion, first sidewall, and second sidewall define a first gap.

In at least one example embodiment, the canister includes a base wall having a first side and a second side, a canister wall about a periphery of the base wall, and a third sidewall extending from the second side of the base wall and spaced apart from and concentric with the canister wall. The canister wall includes a first end extending past the base wall in a first direction and a second end extending past the base wall in a second direction opposite the first direction. The first side of the base wall and the first end of the canister wall define a first cavity and the second side of the base wall, and the second end of the canister wall define a second cavity. The third sidewall, a portion of the second side of the base wall, and the canister wall define a second gap. The second gap is configured to receive at least a portion of the first sidewall of the base and the first gap is configured to receive at least a portion of the second end of canister wall.

In at least one example embodiment, the lid includes a top wall and a peripheral wall extending about a periphery of the top wall. The top wall includes a top surface and a bottom surface.

In at least one example embodiment, the first sidewall and the second sidewall are perpendicular to the central portion.

In at least one example embodiment, a length of the first sidewall is greater than a length of the second sidewall.

In at least one example embodiment, the angle portion and a bottom surface of the bottom wall at least partially define a recess.

In at least one example embodiment, the base includes a first protrusion extending from an interior surface of the first sidewall and the canister includes a second protrusion extending from an exterior surface of the third sidewall. The first protrusion is configured to engage the second protrusion.

In at least one example embodiment, a thickness of a top portion of the canister wall decreases from the second end toward the first end. In at least one example embodiment, the canister wall includes a third protrusion extending from an exterior surface of the canister wall at the first end.

In at least one example embodiment, the lid includes at least one protrusion extending from an interior surface of the peripheral wall. The at least one protrusion of the lid is configured to engage the third protrusion of the canister. The lid defines at least one lid notch on an exterior surface of the peripheral wall and at least a portion of the top surface of the top wall. The at least one lid notch is opposite the at least one protrusion on the interior surface of the lid.

In at least one example embodiment, the third protrusion comprises a plurality of protrusions with an opening defined between each of the plurality of protrusions.

In at least one example embodiment, the second end of the canister wall defines at least one canister notch. The at least one canister notch is aligned with the at least one opening.

In at least one example embodiment, the at least one canister notch is configured to align with the lid notch in the unlocked position.

In at least one example embodiment, at least a portion of a periphery of the second end of the canister wall defines a recess. The recess is configured to contact a top surface of the second sidewall of the base such that the second sidewall and the canister wall are flush when the canister and base are engaged.

In at least one example embodiment, a center portion of the top surface of the top wall defines a recess.

In at least one example embodiment, the lid is configured to move from the locked position to the unlocked position. The lid is configured to be removed from the canister in the unlocked position.

In at least one example embodiment, the canister is configured to engage at least a portion of the base in a snap-fit and the canister is configured to engage at least a portion of the lid in a snap-fit.

At least one example embodiment relates to a method of using a container.

In at least one example embodiment, the method includes establishing a base, a canister, and a lid for the container. The base includes a bottom wall having a central portion, a peripheral portion, and an angle portion between the central portion and the peripheral portion. The base includes a first sidewall extending from a periphery of the peripheral portion and about a periphery of the bottom wall and a second sidewall extending from an end of the peripheral portion opposite the first sidewall. The first sidewall and the second sidewall extend perpendicular to the peripheral portion such that the peripheral portion, first sidewall, and second sidewall define a first gap.

In at least one example embodiment, the canister includes a base wall having a first side and a second side, a canister wall about a periphery of the base wall, and a third sidewall extending from the second side of the base wall and spaced apart from the canister wall. The canister wall includes a first end extending past the base wall in a first direction and a second end extending past the base wall in a second direction opposite the first direction. The first side of the base wall and the first end of the canister wall define a first cavity and the second side of the base wall and the second end of the canister wall defining a second cavity. A portion of the second side of the base wall and the canister wall define a second gap.

In at least one example embodiment, the lid includes a top wall and a peripheral wall extending about a periphery of the top wall. The top wall includes a top surface and a bottom surface.

In at least one example embodiment, the method further includes connecting the base to the canister such that the second gap is configured to receive at least a portion of the first sidewall and the first gap is configured to receive at least a portion of the canister wall. The method further includes connecting the lid to the canister. The lid is configured to rotate between a locked position and an unlocked position. The method further includes rotating the lid from the locked position to the unlocked position such that the lid is removable from the canister.

In at least one example embodiment, the connecting the base to the canister comprises engaging a first protrusion extending from an interior surface of the first sidewall of the base with a second protrusion extending from an exterior surface of the third sidewall of the canister.

In at least one example embodiment, the connecting the lid to the canister comprises engaging a third protrusion extending from an exterior surface of the canister wall and adjacent the first end of the canister wall with at least one protrusion extending from an interior surface of the peripheral wall of the lid.

In at least one example embodiment, the third protrusion defines at least one opening, the second end of the canister wall defines at least one canister notch, and the lid defines at least one lid notch on an exterior surface of the peripheral wall and at least a portion of the top surface of the top wall. The at least one canister notch is aligned with the at least one opening. The at least one lid notch is opposite the at least one protrusion on the interior surface of the lid.

In at least one example embodiment, the rotating the lid from the locked position to the unlocked position includes aligning the lid notch with the canister notch.

In at least one example embodiment, the method includes disengaging the at least one protrusion of the lid from the third protrusion of the canister through the at least one opening such that the lid is removed from the canister and the first cavity is exposed.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1A:
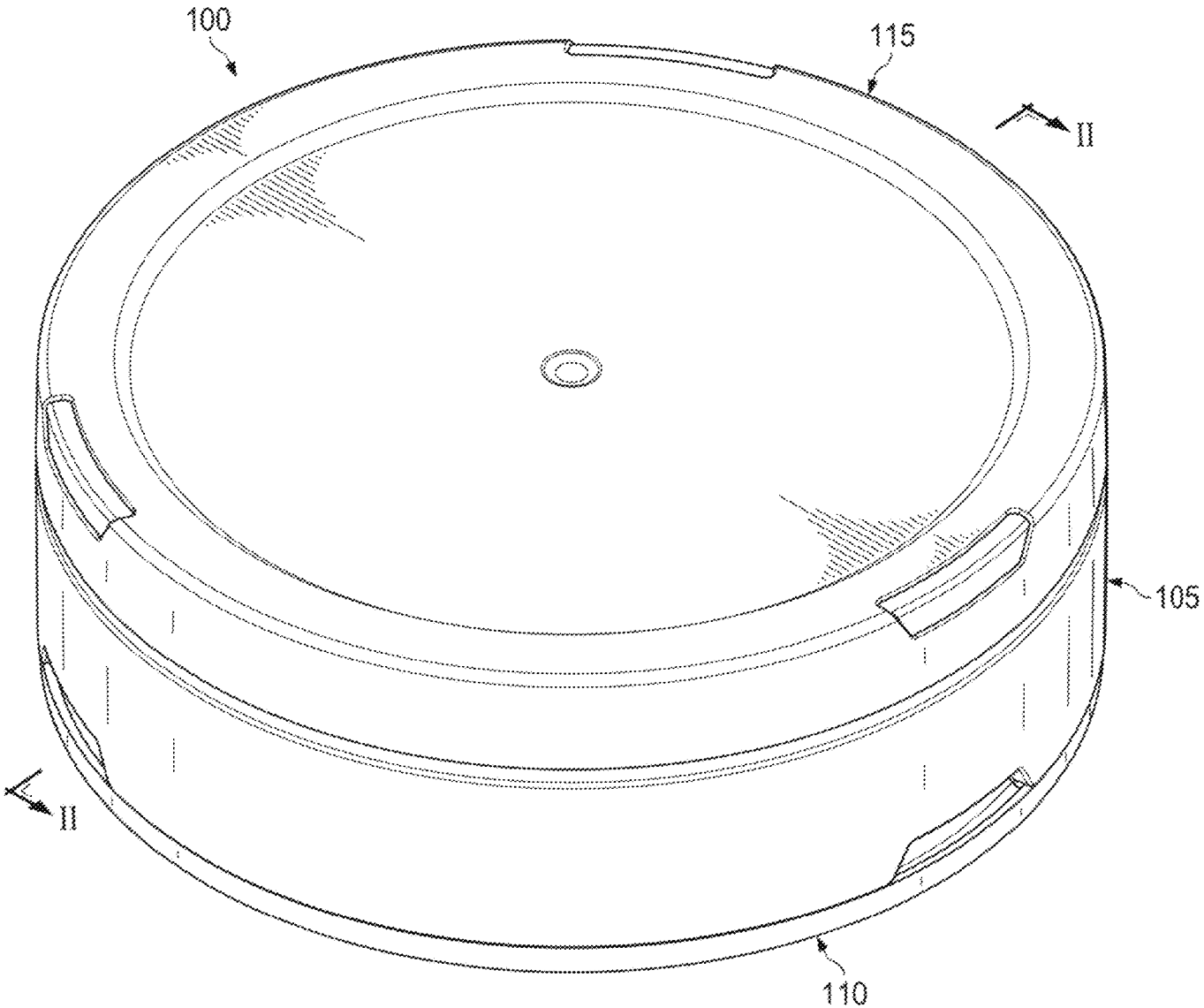
FIG. 1A is a front perspective view of a container according to at least one example embodiment.

Some detailed example embodiments are disclosed herein. However, specific structural and functional details disclosed herein are merely representative for purposes of describing some example embodiments. Example embodiments may, however, be embodied in many alternate forms and should not be construed as limited to only example embodiments set forth herein.

Accordingly, while example embodiments are capable of various modifications and alternative forms, example embodiments thereof are shown by way of example in the drawings and will herein be described in detail. It should be understood, however, that there is no intent to limit an example embodiment to the particular forms disclosed, but to the contrary, example embodiments are to cover all modifications, equivalents, and alternatives falling within the scope of an example embodiment. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiment.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiment only and is not intended to be limiting of example embodiment. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements and/or groups thereof.

Example embodiments are described herein with reference to cross-sectional illustrations that are schematic illustrations of example embodiment. As such, variations from the shapes of the illustrations are to be expected. Thus, example embodiment should not be construed as limited to the shapes of regions illustrated herein but are to include deviations and variations in shapes.

When the words "about" and "substantially" are used in this specification in connection with a numerical value, it is intended that the associated numerical value include a tolerance of ±10% around the stated numerical value, unless otherwise explicitly defined. Moreover, when the terms "generally" or "substantially" are used in connection with geometric shapes, it is intended that precision of the geometric shape is not required but that latitude for the shape is within the scope of the disclosure. Furthermore, regardless of whether numerical values or shapes are modified as "about," "generally," or "substantially," it will be understood that these values and shapes should be construed as including a manufacturing or operational tolerance (e.g., ±10%) around the stated numerical values or shapes.

Unless otherwise defined, all terms (including technical and scientific terms) used herein have the same meaning as commonly understood by one of ordinary skill in the art to which example embodiment belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Figure 1B:
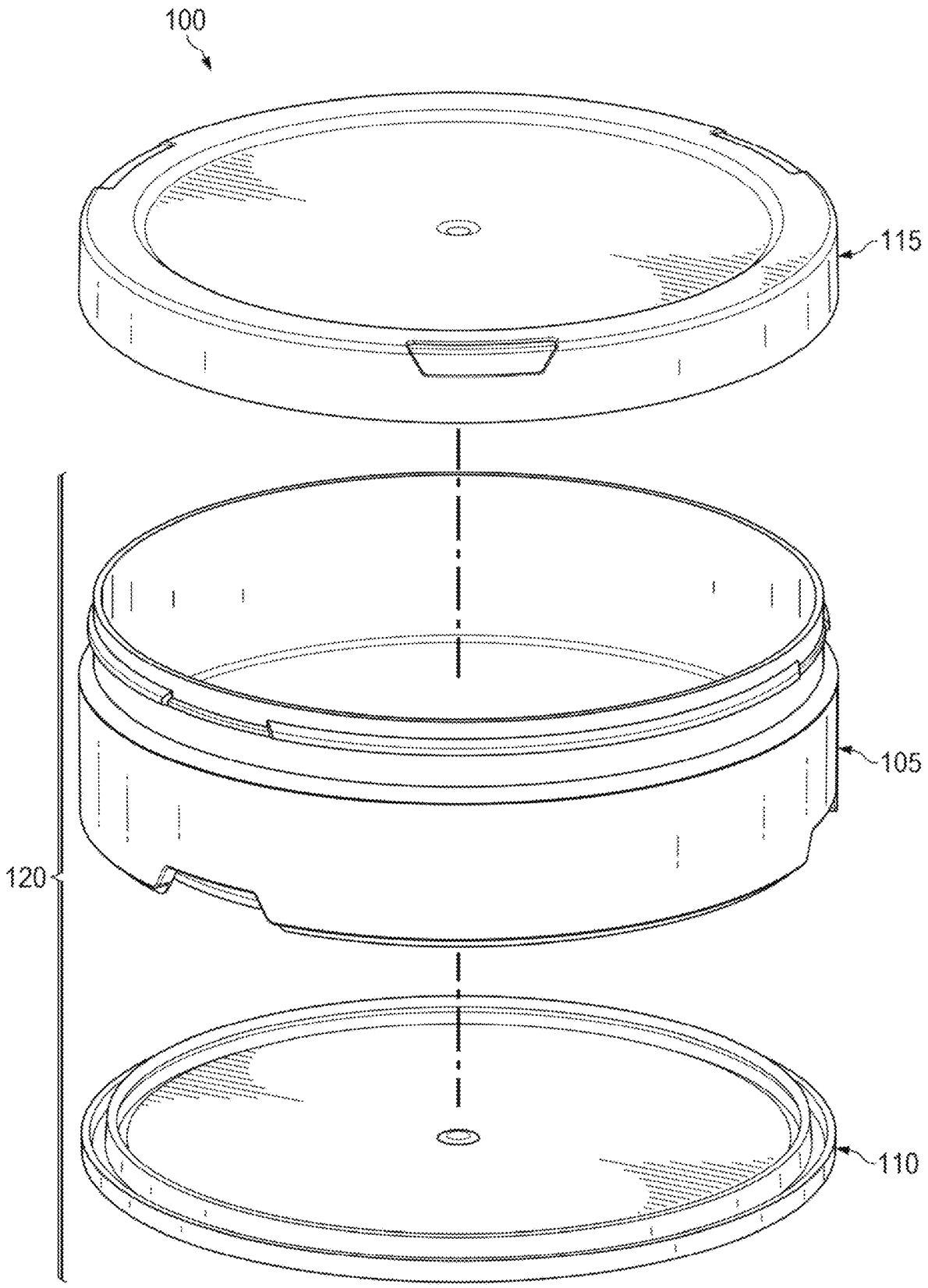
FIG. 1B is an exploded view of a canister, a base, and a lid of the container of FIG. 1 according to at least one example embodiment.

FIG. 1A is a front perspective view of a container including a canister, a base, and a lid according to at least one example embodiment. FIG. 1B is an exploded view of a canister, a base, and a lid of the container of FIG. 1A according to at least one example embodiment.

In at least one example embodiment, the container 100 includes or can contain at least one substance. In at least one example embodiment, the at least one substance is a consumer product. In at least one example embodiment, the at least one substance and/or the consumer product includes an oral product. In at least one example embodiment, the oral product is one or more pouches.

In at least one example embodiment, the oral product is an oral tobacco product, an oral non-tobacco product, an oral cannabis product, or any combination thereof. The oral product may be in a form of loose material (e.g., loose cellulosic material), shaped material (e.g., plugs or twists), pouched material, tablets, lozenges, chews, gums, films, any other oral product, or any combination thereof.

The oral product may include chewing tobacco, snus, moist snuff tobacco, dry snuff tobacco, other smokeless tobacco and non-tobacco products for oral consumption, or any combination thereof.

Where the oral product is an oral tobacco product including smokeless tobacco product, the smokeless tobacco product may include tobacco that is whole, shredded, cut, granulated, reconstituted, cured, aged, fermented, pasteurized, or otherwise processed. Tobacco may be present as whole or portions of leaves, flowers, roots, stems, extracts (e.g., nicotine), or any combination thereof.

In at least one example embodiment, the oral product includes a tobacco extract, such as a tobacco-derived nicotine extract, and/or synthetic nicotine. The oral product may include nicotine alone or in combination with a carrier (e.g., white snus), such as a cellulosic material. The carrier may be a non-tobacco material (e.g., microcrystalline cellulose) or a tobacco material (e.g., tobacco fibers having reduced or eliminated nicotine content, which may be referred to as "exhausted tobacco plant tissue or fibers"). In some example embodiments, the exhausted tobacco plant tissue or fibers can be treated to remove at least 25%, 40%, 50%, 60%, 70%, 75%, 80%, 85%, 90%, or 95% of the nicotine. For example, the tobacco plant tissue can be washed with water or another solvent to remove the nicotine.

In other example embodiments, the oral product may include cannabis, such as cannabis plant tissue and/or cannabis extracts. In at least one example embodiment, the cannabis material includes leaf and/or flower material from one or more species of cannabis plants and/or extracts from the one or more species of cannabis plants. The one or more species of cannabis plants may include Cannabis sativa, Cannabis indica, and/or Cannabis ruderalis. In at least one example embodiment, the cannabis may be in the form of fibers. In at least one example embodiment, the cannabis may include a cannabinoid, a terpene, and/or a flavonoid. In at least one example embodiment, the cannabis material may be a cannabis-derived cannabis material, such as a cannabis-derived cannabinoid, a cannabis-derived terpene, and/or a cannabis-derived flavonoid.

The oral product (e.g., the oral tobacco product, the oral non-tobacco product, or the oral cannabis product) may have various ranges of moisture. In at least one example embodiment, the oral product is a dry oral product having a moisture content ranging from 5% by weight to 10% by weight. In at least one example embodiment, the oral product has a medium moisture content, such as a moisture content ranging from 20% by weight to 35% by weight. In at least one example embodiment, the oral product is a wet oral product having a moisture content ranging from 40% by weight to 55% by weight.

In at least one example embodiment, oral product may further include one or more elements such as a mouth-stable polymer, a mouth-soluble polymer, a sweetener (e.g., a synthetic sweetener and/or a natural sweetener), an energizing agent, a soothing agent, a focusing agent, a plasticizer, mouth-soluble fibers, an alkaloid, a mineral, a vitamin, a dietary supplement, a nutraceutical, a coloring agent, an amino acid, a chemesthetic agent, an antioxidant, a food-grade emulsifier, a pH modifier, a botanical, a tooth-whitening agent, a therapeutic agent, a processing aid, a stearate, a wax, a stabilizer, a disintegrating agent, a lubricant, a preservative, a filler, a flavorant, flavor masking agents, a bitterness receptor site blocker, a receptor site enhancers, other additives, or any combination thereof.

In at least one example embodiment, the package may contain any product or substance. For example, the package may contain confectionary products, food products, medicines, or any other product.

In at least one example embodiment, the container 100 includes a canister 105, a base 110, and a lid 115. The canister 105, the base 110, and the lid 115 may each have a circular or cylindrical shape. The base 110 and the lid 115 may be removably coupled to opposing sides of the canister 105, as will be discussed in relation to FIGS. 2-10. In at least one example embodiment, the canister 105 and the base 110 may form a canister assembly 120 of the container 100.

Figure 2:
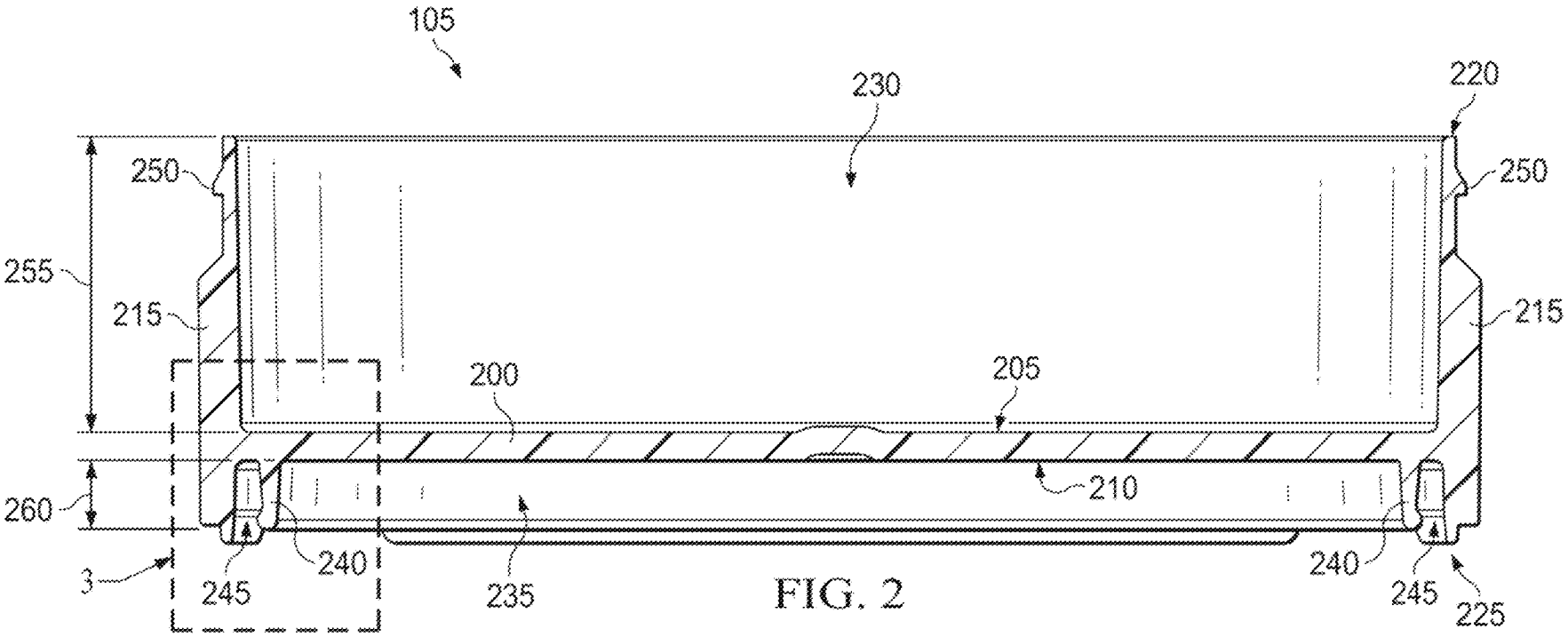
FIG. 2 is a sectional view of the canister of the container of FIG. 1A along line II-II according to at least one example embodiment.

FIG. 2 is a sectional view of the canister 105 of the container 100 of FIG. 1A along line II-II according to at least one example embodiment.

In at least one example embodiment, the canister 105 includes a base wall 200 having a first side 205 and a second side 210 opposite the first side 205. The canister 105 also includes a canister wall 215 extending about a periphery of the base wall 200. The canister wall 215 may also extend perpendicular to the base wall 200. In at least one example embodiment, the canister wall 215 is cylindrical.

The canister wall 215 includes a first end 220 extending past the base wall 200 in a first direction and a second end 225 extending past the base wall 200 in a second direction. The second direction may be opposite the first direction. In at least one example embodiment, the first side 205 of the base wall and the canister wall 215 extending in the first direction towards the first end 220 of the canister wall define a first cavity 230, and the second side 210 of the base wall 200 and the canister wall 215 extending in the second direction toward the second end 225 define a second cavity 235. The first cavity 230 may include a first depth 255 and the second cavity 235 may include a second depth 260. In at least one example embodiment, the first depth 255 is greater than the second depth 260. In at least one example embodiment, the first cavity 230 may be configured to hold a product, such as an oral pouch product. The second cavity 235 may be a disposal area configured to hold an oral pouch product after consumption by an adult consumer.

In at least one example embodiment, the canister 105 includes a sidewall 240 extending from the second side 210 of the base wall 200. The sidewall 240 may be perpendicular to the base wall 200. In at least one example embodiment, the sidewall 240 is cylindrical. In at least one example embodiment, the sidewall 240 is spaced a distance from the second end 225 of the canister wall 215. For example, the sidewall 240 may be concentric with the canister wall 215. In at least one example embodiment, the sidewall 240, at least a portion of the canister wall 215 adjacent the second end 225, and at least a portion of the second side 210 of the base wall 200 define a gap 245. The gap 245 may be configured to receive at least a portion of the base 110, as will be discussed below and shown in relation to FIGS. 5-7. In at least one example embodiment, the gap 245 is cylindrical. In at least one example embodiment, the second end 225 of the canister wall 215 may extend past the sidewall 240.

In at least one example embodiment, a protrusion 250 may extend outward from an exterior surface of the canister wall 215 adjacent the first end 220 of the canister wall 215. For example, when the canister wall 215 is cylindrical, the protrusion 250 may extend radially outward from the exterior surface of the canister wall 215. The protrusion 250 may be configured to engage at least a portion of the lid 115, as will be discussed below in relation to FIGS. 8-10. The protrusion 250 may comprise a trapezoidal, circular, ovular, rectangular, or polygonal shape in cross-section. The protrusion 250 may have a beveled or tapered edge to facilitate engagement with at least a portion of the lid 115.

In at least one example embodiment, the first end 220 of the canister wall 215 may taper from an exterior surface toward an interior surface of the canister wall 215. For example, a thickness of the first end 220 of the canister wall 215 may be less than a thickness of the second end 225 and/or a middle portion 217 of the canister wall 215. In such example embodiments, the protrusion 250 may extend from the tapered portion adjacent the first end 220 of the canister wall 215.

Figure 3:
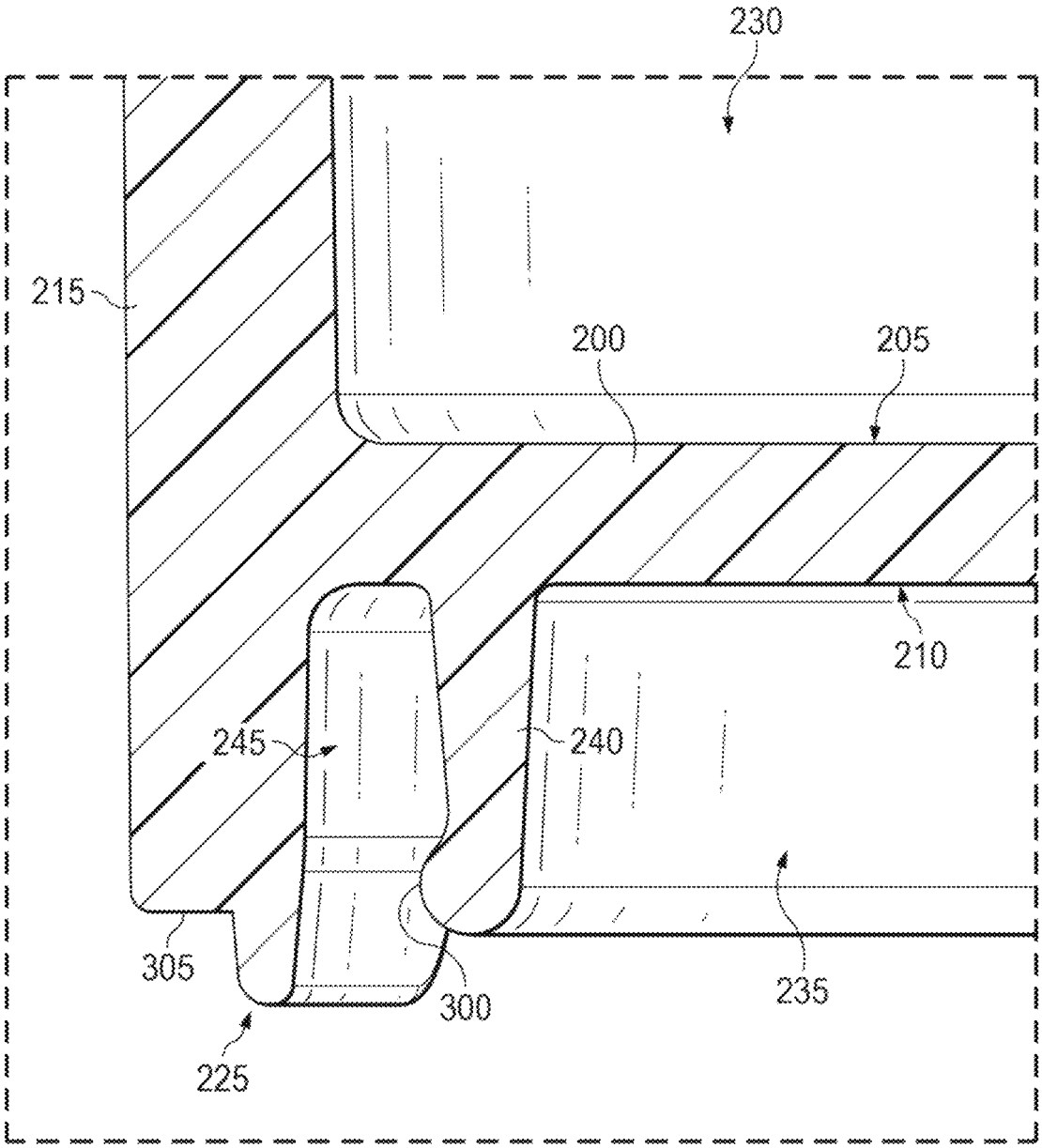
FIG. 3 is a detailed sectional view of the canister of FIG. 2 according to at least one example embodiment.

FIG. 3 is a detailed sectional view of the canister 105 of FIG. 2 according to at least one example embodiment.

In at least one example embodiment, the sidewall 240 may include a protrusion 300 extending from an exterior surface of the sidewall 240. For example, when the sidewall 240 is cylindrical, the protrusion 300 may extend radially outward from the exterior surface of the sidewall 240 and into the gap 245. In at least one example embodiment, the protrusion 300 extends from an end of the sidewall 240. In at least one example embodiment, the protrusion 300 is continuous about the sidewall 240. In at least one other example embodiment, the protrusion 300 may be discontinuous about the sidewall 240. For example, the protrusion 300 may include two or more protrusions 300. In at least one example embodiment, the protrusion 300 is configured to engage at least a portion of the base 110, such as in a snap-fit, as will be discussed below in relation to FIGS. 5-7. The protrusion 300 may comprise a trapezoidal, circular, ovular, rectangular, or polygonal shape in cross-section. The protrusion 300 may have a beveled or tapered edge to facilitate engagement with at least a portion of the base 110.

In at least one example embodiment, at least a portion of the second end 225 of the canister wall 215 may define a recess 305. The recess may extend about a circumference of the second end 225 of the canister wall 215 along an outer surface of the canister wall 215. For example, the recess 305 may be cylindrical. In at least one example embodiment, the recess 305 is configured to receive at least a portion of the base 110 such that the base 110 is flush with the canister 105, as shown and described with respect to FIG. 7.

Figure 4:
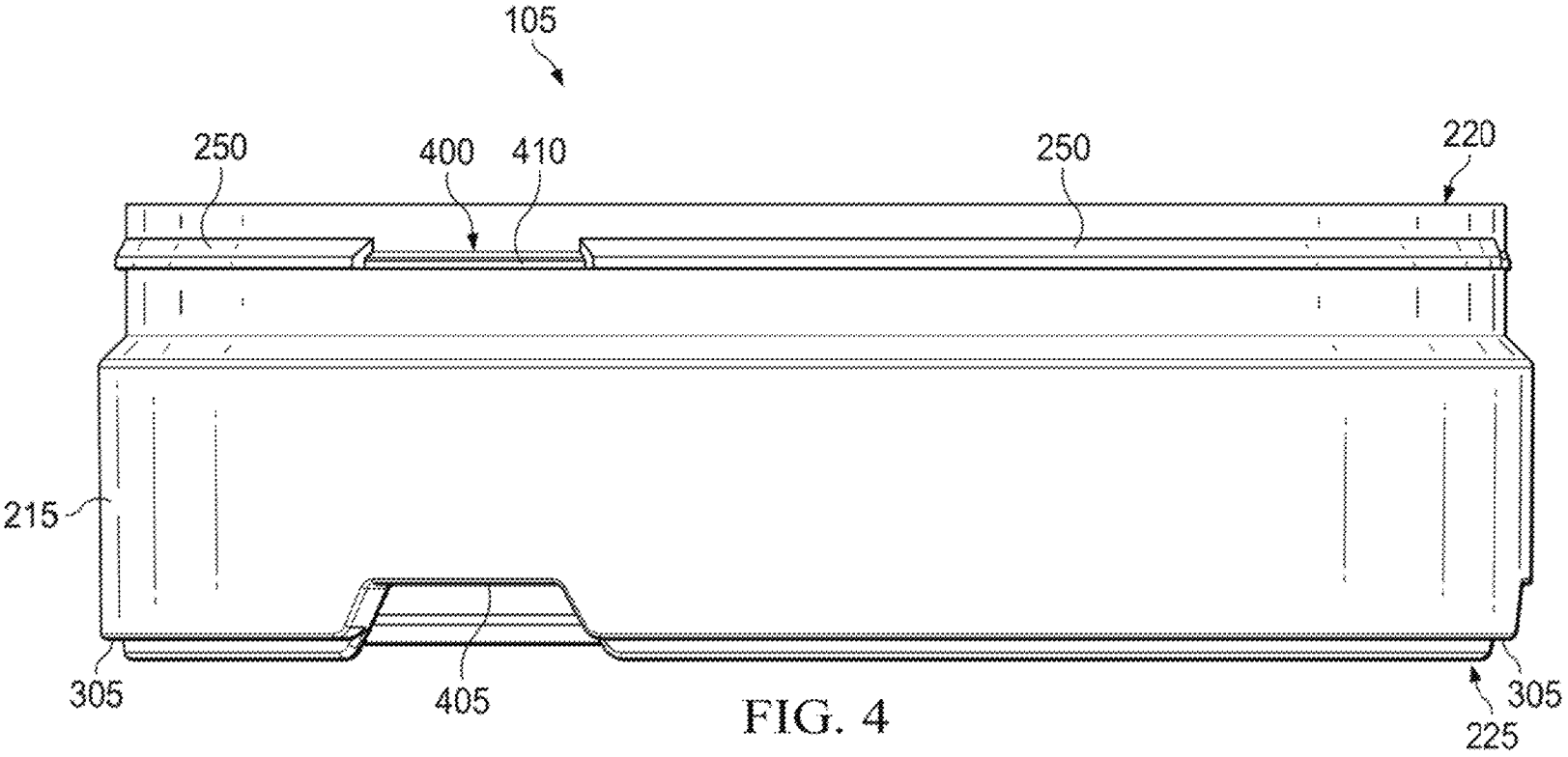
FIG. 4 is a front view of the canister of FIGS. 1A-1B according to at least one example embodiment.

FIG. 4 is a front view of the canister 105 of FIGS. 1A-1B according to at least one example embodiment.

In at least one example embodiment, the protrusion 250 may be discontinuous about the canister wall 215. For example, the protrusion 250 may comprise two or more protrusions 250. In such embodiments, the two or more protrusions 250 may define two or more openings 400 between each of the two or more protrusions 250. In at least one other example embodiment, the protrusion 250 may be continuous about the canister wall 215.

In at least one example embodiment, each of the openings 400 may include a flange 410. The flange 410 may extend from an exterior surface of the sidewall 240. For example, when the sidewall 240 is cylindrical, the flange 410 may extend radially outward from the exterior surface of the sidewall 240 and into the opening 400. The flange 410 may comprise a trapezoidal, circular, ovular, rectangular, or polygonal shape. The flange 410 may have a beveled or tapered edge to facilitate engagement with at least a portion of the lid 115, as will be discussed below in relation to FIG. 10A.

In at least one example embodiment, the second end 225 of the canister wall 215 defines one or more notches 405. For example, each of the notches 405 may extend at least partially from the second end 225 toward the first end 220 of the canister wall 215. In at least one example embodiment, each of the notches 405 adjacent the second end 225 of the canister wall 215 are configured to align with each of the openings 400 adjacent the first end 220 of the canister wall 215. For example, the notches 405 may be configured to indicate a location of the openings 400 when the lid 115 is attached to the canister 105, as will be discussed with respect to FIGS. 10-12 below.

Figure 5:
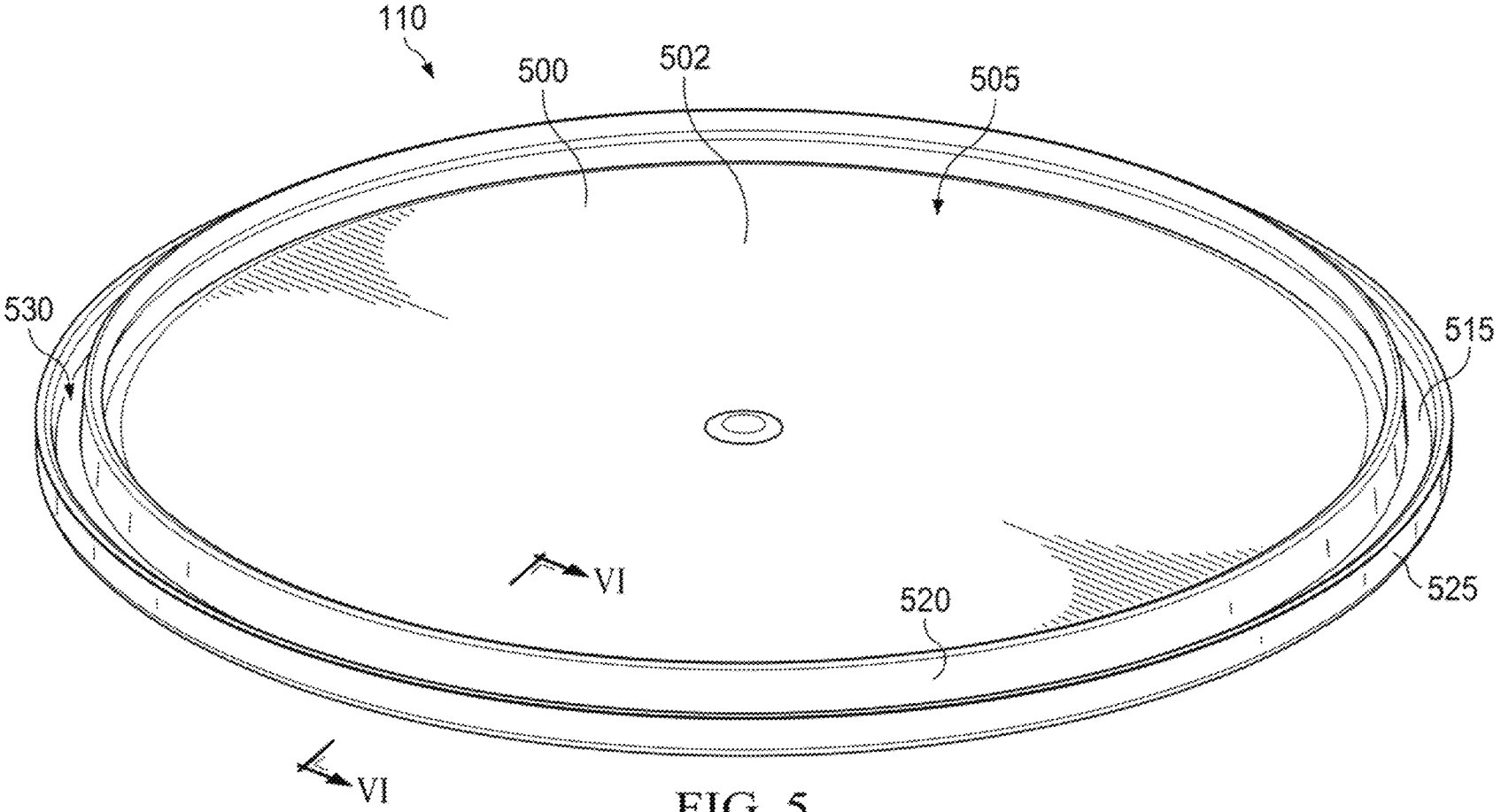
FIG. 5 is a top perspective view of the base of FIGS. 1A-1B according to at least one example embodiment.
Figure 6:
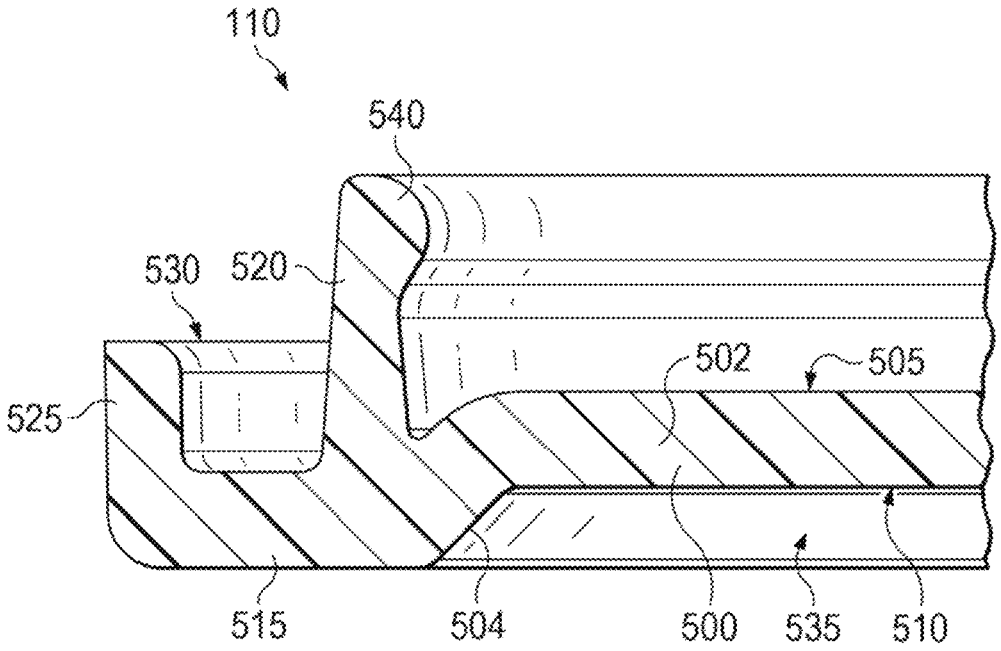
FIG. 6 is a detailed sectional view of the base of FIG. 5 along line VI-VI according to at least one example embodiment.

FIG. 5 is a top perspective view of the base 110 of FIGS. 1A-1B according to at least one example embodiment. FIG. 6 is a detailed sectional view of the base 110 of FIG. 5 along line VI-VI according to at least one example embodiment.

In at least one example embodiment, as shown in FIGS. 5-6, the base 110 includes a bottom wall 500, a first sidewall 520, and a second sidewall 525. The bottom wall 500 includes a central portion 502, a peripheral portion 515 and an angle portion 504 between the central portion 502 and the peripheral portion 515. In one embodiment, the angle portion 504 and the peripheral portion 515 are parallel but not co-planar, and the angle portion 504 extends at an angle with respect to the central portion 502. In one embodiment, the central portion 502 includes a top surface 505 and a bottom surface 510. In at least one other example embodiment, the bottom surface 510 of the central portion 502 is flat or planar (or substantially flat or planar). In at least one embodiment the peripheral portion 515 is flat or planar (or substantially flat or planar). In at least one example embodiment, at least a portion of the peripheral portion 515 and the bottom surface 510 of the central portion 502 define a recess 535.

In at least one example embodiment, the peripheral portion 515 forms a periphery of the bottom wall 500. The second sidewall 525 may extend from the peripheral portion 515 at the periphery of the bottom wall 500 and the first sidewall 520 may extend from an end of the peripheral portion 515 opposite the second sidewall 525. For example, the first sidewall 520 and the second sidewall 525 may be perpendicular to the central portion 502 and the peripheral portion 515. The first sidewall 520, the peripheral portion 515, and the second sidewall 525 may also define a gap 530. In at least one example embodiment, the first sidewall 520, the second sidewall 525, and the gap 530 are cylindrical. In at least one example embodiment, the gap 530 may be configured to receive at least a portion of the canister 105. For example, the gap 530 may be configured to receive at least a portion of the second end 225 of the canister wall 215 of the canister, such as in a snap fit, as will be discussed with respect to FIG. 7 below. In at least one example embodiment, a length of the first sidewall 520 may be greater than a length of the second sidewall 525.

In at least one example embodiment, a protrusion 540 may extend inwardly from an interior surface of the first sidewall 520. For example, when the first sidewall 520 is cylindrical, the protrusion 540 may extend radially inward from the interior surface of the first sidewall 520. In at least one example embodiment, the protrusion 540 is continuous about the first sidewall 520. In at least one other example embodiment, the protrusion 540 may be discontinuous about the first sidewall 520. For example, the protrusion 540 may comprise two or more protrusions 540. The protrusion 540 may comprise a trapezoidal, circular, ovular, rectangular, or polygonal shape in cross-section. The protrusion 540 may have a beveled or tapered edge to facilitate engagement with at least a portion of the canister 105.

Figure 7:
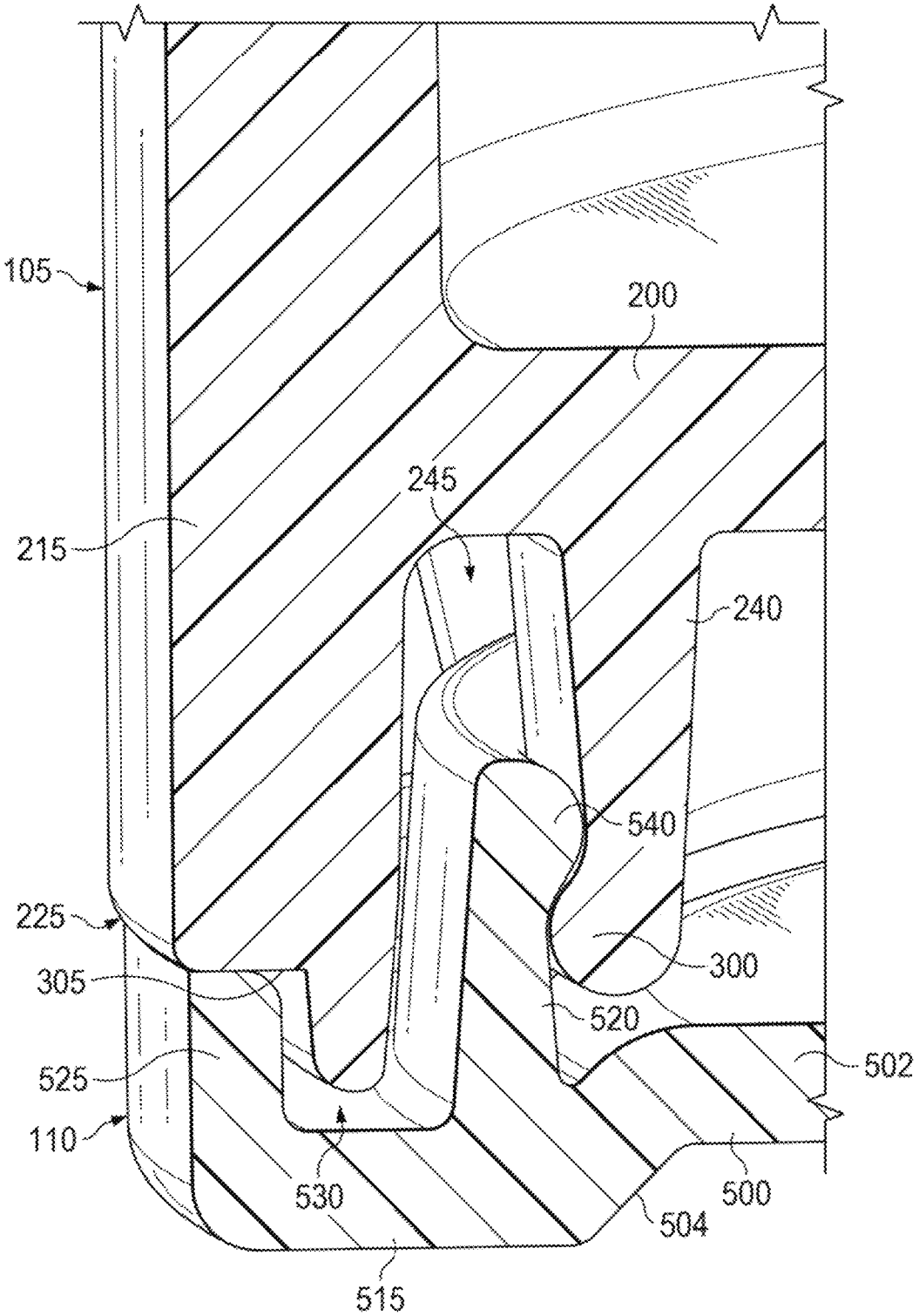
FIG. 7 is a detailed sectional view of the canister and the base of FIG. 1A along line II-II according to at least one example embodiment.

FIG. 7 is a detailed sectional view of the canister 105 and the base 110 of FIG. 1A along line II-II according to at least one example embodiment.

In at least one example embodiment, the base 110 is configured to be removably coupled to the canister 105. For example, the base 110 may be coupled to the canister 105 by a snap-fit. In at least one example embodiment, the gap 530 of the base 110 is configured to receive at least a portion of the second end 225 of the canister wall 215. At least a portion of the second end 225 of the canister wall 215 may be spaced apart from peripheral portion 515 within the gap 530. In at least one other example embodiment, at least a portion of the second end 225 of the canister wall 215 may be in contact with the peripheral portion 515 within the gap 530. In at least one example embodiment, another portion of the second end 225 of the canister wall 215 may be in contact with an end of the second sidewall 525 of the base 110. For example, the recess 305 of the canister 105 may receive an end of the second sidewall 525 of the base 110 such that exterior surfaces of the second sidewall 525 of the base 110 and the canister wall 215 of the canister 105 are flush.

In at least one example embodiment, the gap 245 of the canister 105 is configured to receive at least a portion of the base 110. For example, the gap 245 may receive at least a portion of the first sidewall 520 of the base 110. In at least one example embodiment, the protrusion 540 of the base 110 is configured to engage the protrusion 300 of the canister 105 and secure the base 110 to the canister 105. For example, the beveled or tapered edge of the protrusion 540 may be configured to slide past the beveled or tapered edge of the protrusion 300 such that the protrusion 540 and the protrusion 300 are engaged and couple the base 110 to the canister 105.

Figure 8:
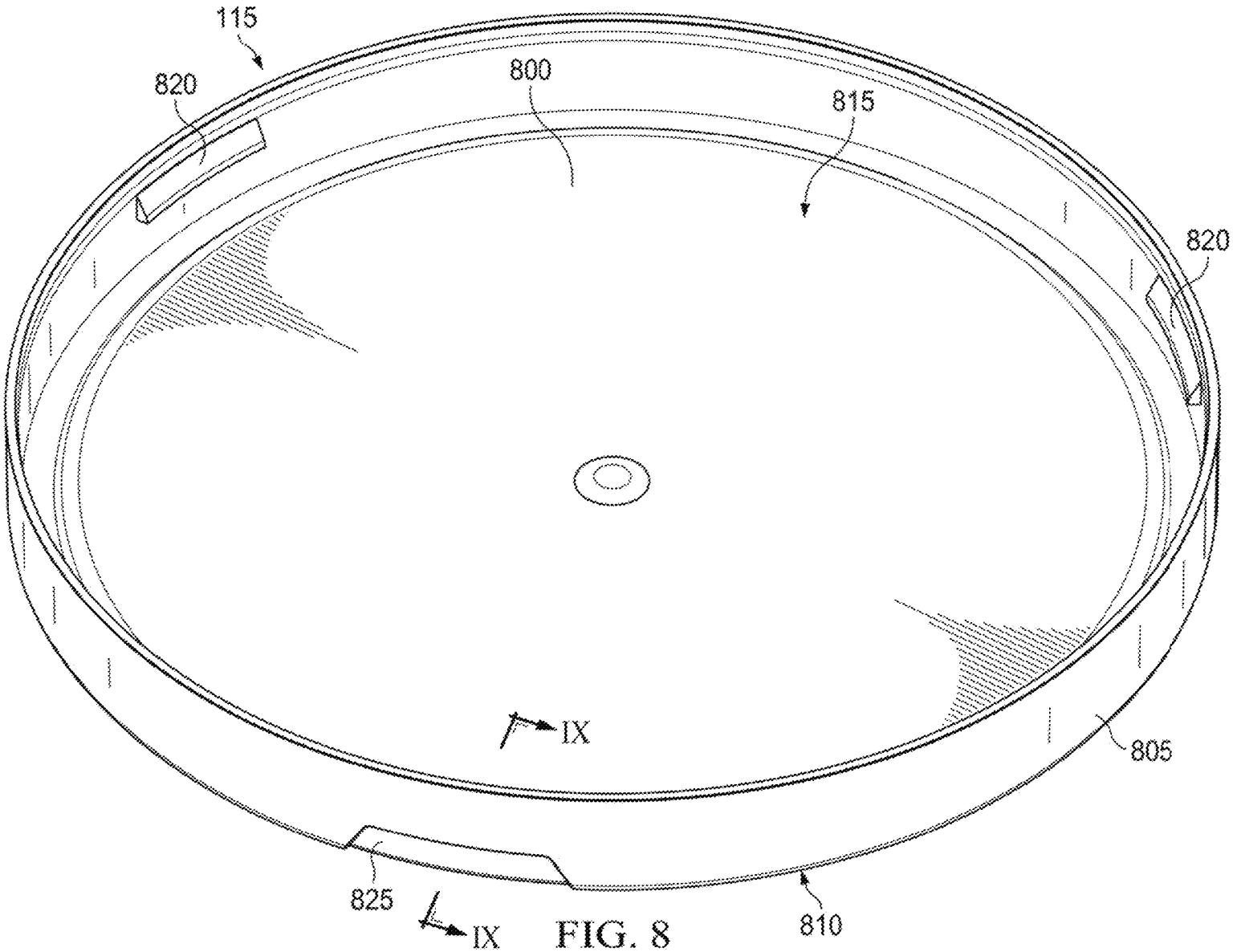
FIG. 8 is a bottom perspective view of the lid of FIGS. 1A-1B according to at least one example embodiment.
Figure 9:
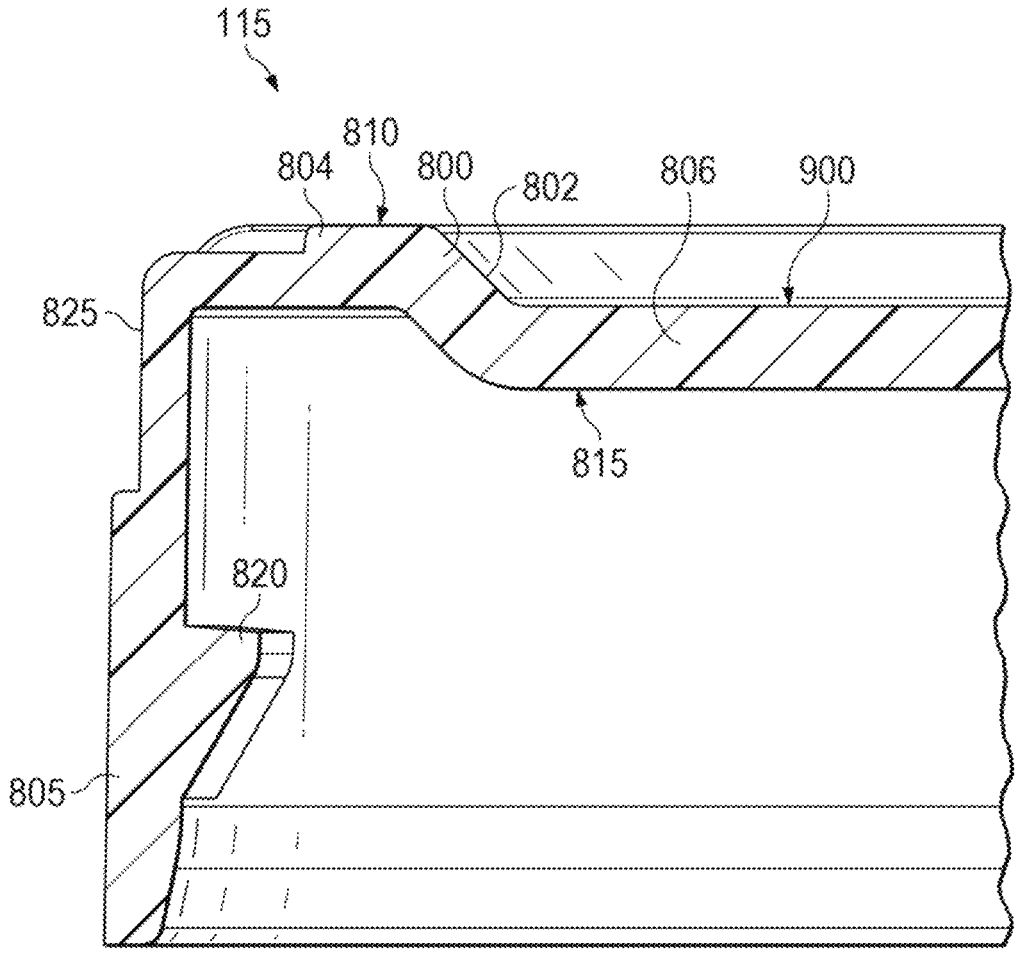
FIG. 9 is a detailed sectional view of the lid of FIG. 8 along line IX-IX according to at least one example embodiment.

FIG. 8 is a bottom perspective view of the lid 115 of FIGS. 1A-1B according to at least one example embodiment. FIG. 9 is a detailed sectional view of the lid of FIG. 8 along line IX-IX according to at least one example embodiment.

In at least one example embodiment, as shown in FIGS. 8-9, the lid 115 includes a top wall 800 and a peripheral wall 805. The top wall 800 includes a top surface 810 and a bottom surface 815. The peripheral wall 805 extends from the bottom surface 815 of the top wall 800. For example, the peripheral wall 805 may be cylindrical and annularly extend about a circumference of the top wall 800. In at least one other example embodiment, the peripheral wall 805 may extend from an edge of the top wall 800.

In at least one example embodiment, the peripheral wall 805 includes one or more protrusions 820 extending from at least a portion of an interior surface of the peripheral wall 805. The one or more protrusions 820 may be equally spaced about a circumference of an interior surface of the peripheral wall 805. The one or more protrusions 820 may comprise a trapezoidal, circular, ovular, rectangular, or polygonal shape in cross-section. The protrusion 820 may have a beveled or tapered edge to facilitate engagement with at least a portion of the canister 105.

In at least one example embodiment, at least a portion of an exterior surface of the peripheral wall 805 and/or an exterior surface of the top wall 800 define one or more notches 825. Each of the notches 825 are configured to be aligned with each of the protrusions 820 on an opposite side of the peripheral wall 805. The notches 825 may comprise a trapezoidal, circular, ovular, rectangular, or polygonal shape in cross-section.

In at least one example embodiment, the notches 825 may extend from a top portion of the peripheral wall 805 to an edge of the top wall 800, as shown in FIG. 9. In at least one other example embodiment, only a portion of the peripheral wall 805 defines each of the notches 825 adjacent each of the protrusions 820. In at least one other example embodiment, only a portion of the top surface 810 of the top wall 800 defines each of the notches 825 adjacent each of the protrusions 820.

In at least one example embodiment, the top surface 810 of the top wall 800 defines a recess 900. For example, the top wall 800 may include an angle portion 802 between a peripheral portion 804 and a center portion 806 of the top wall 800. In one embodiment, the angle portion 802 and the peripheral portion 804 are parallel but not co-planar, and the angle portion 802 extends at an angle with respect to the center portion 806. In at least one example embodiment, the recess 900 may be circular and positioned in at least the center portion 806 of the top wall 800. In at least one other example embodiment, the top wall 800 may be substantially flat or planar.

Figure 10A:
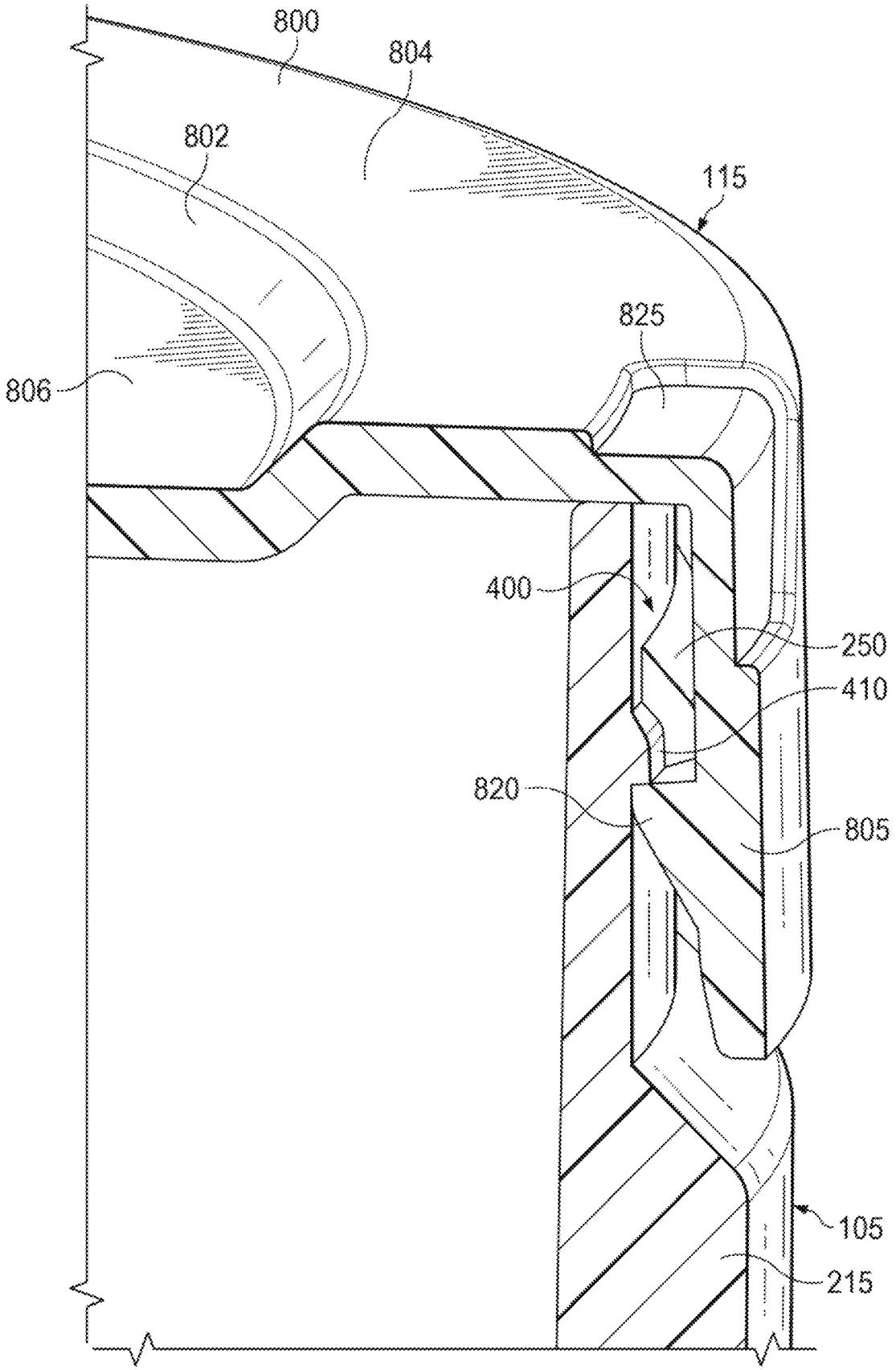
FIG. 10A is a detailed sectional view of the canister and the lid of FIG. 1A in an unlocked position according to at least one example embodiment.
Figure 10B:
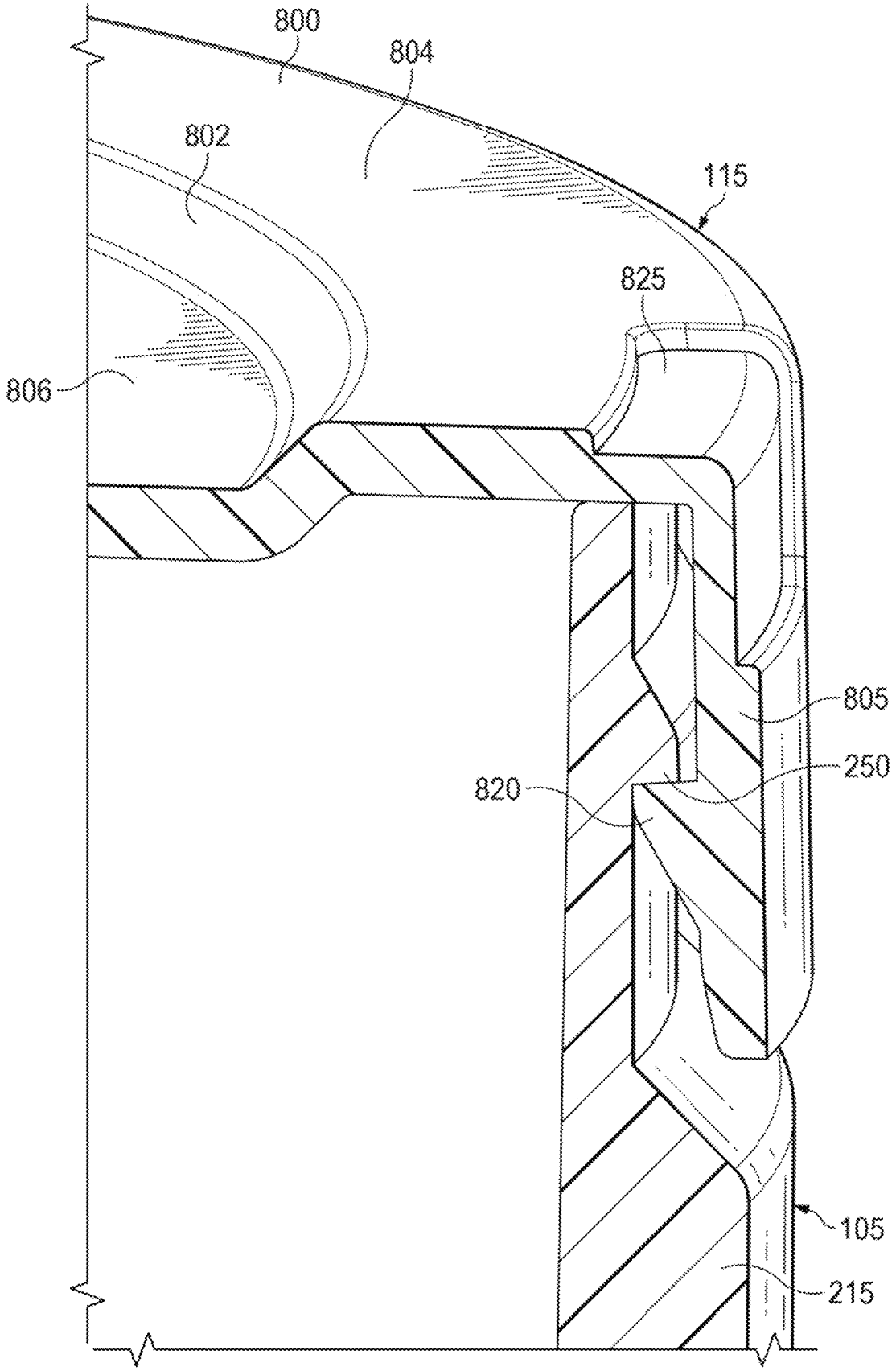
FIG. 10B is a detailed sectional view of the canister and the lid of FIG. 1A in a locked position according to at least one example embodiment.

FIG. 10A is a detailed sectional view of the canister and the lid of FIG. 1A in an unlocked position according to at least one example embodiment. FIG. 10B is a detailed sectional view of the canister and the lid of FIG. 1A in a locked position according to at least one example embodiment.

In at least one example embodiment, the lid 115 is configured to be removably coupled to the canister 105. In at least one example embodiment, when the canister 105 and the lid 115 are in the unlocked position, as shown in FIG. 10A, the protrusion 820 may be configured to slide through at least one of the openings 400 of the canister 105. In at least one example embodiment, the protrusion 820 may be configured to engage with the flange 410. For example, by applying an upward force with reference to FIG. 10A, the beveled or tapered edge of the protrusion 820 may be configured to slide past the beveled or tapered edge of the flange 410 such that, absent the upward force, the protrusion 820 and the flange 410 are engaged and prevent the lid 115 from falling off or from being easily removed while the protrusion 820 is aligned with the opening 400 in the unlocked position. In at least one example embodiment, the lid 115 may be rotated from the unlocked position, shown in FIG. 10A, to the locked position, shown in FIG. 10B. In the locked positioned, the protrusion 820 is engaged with the protrusion 250 and the lid 115 is secured to the canister 105.

In at least one example embodiment, the lid 115 may be coupled to the canister 105 by a snap-fit. For example, the beveled or tapered edge of the protrusion 820 may be configured to slide past the beveled or tapered edge of the protrusion 250 such that the protrusion 820 and the protrusion 250 are engaged and couple the lid 115 to the canister 105 in the locked position.

Figure 11:
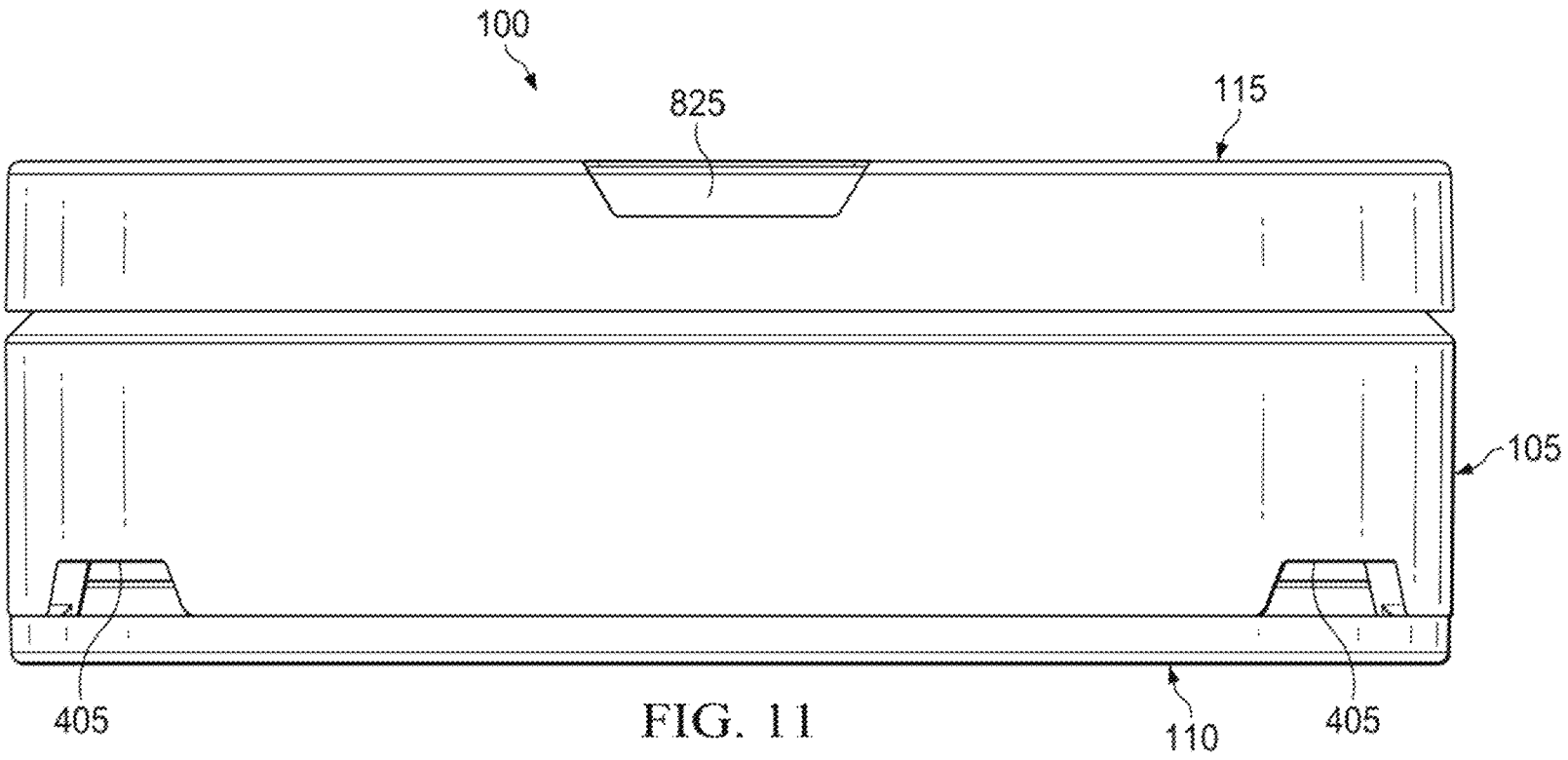
FIG. 11 is a front view of the container of FIG. 1A in the locked position according to at least one example embodiment.
Figure 12:
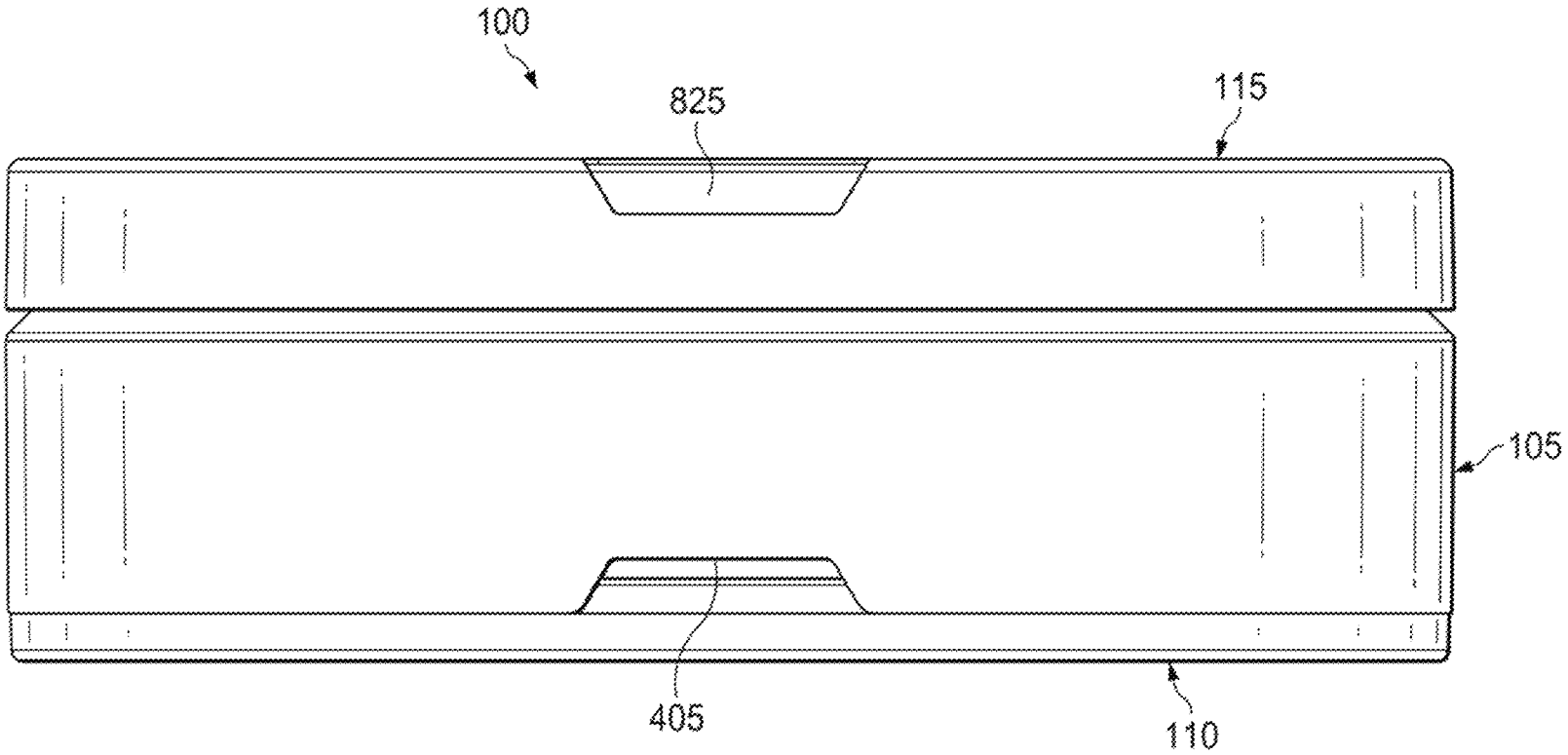
FIG. 12 is a front view of the container of FIG. 1A in the unlocked position according to at least one example embodiment.

FIG. 11 is a front view of the container 100 of FIG. 1A in the locked position according to at least one example embodiment. FIG. 12 is a front view of the container 100 of FIG. 1A in the unlocked position according to at least one example embodiment.

In at least one example embodiment, in the locked position, the notches 825 of the lid 115 are misaligned with the notches 405 of the canister 105, as shown in FIG. 11, for example. In the locked position, the protrusions 820 of the lid 115 are engaged with the protrusions 250 of the canister 105, as shown in FIG. 10B.

In at least one example embodiment, the lid 115 may be rotated between the locked position and the unlocked position. In the unlocked position, notches 825 of the lid 115 are aligned with the notches 405, as shown in FIG. 12. In the unlocked position, the protrusions 820 of the lid 115 are aligned with the openings 400 of the canister 105, as shown in FIG. 10A, such that the lid 115 may be removed from the canister 105. For example, the protrusions 820 of the lid 115 may no longer be engaged with the protrusions 250 of the canister 105 and the lid 115 may be removed from the canister 105 by sliding the protrusions 820 of the lid 115 over the flange 410 and/or through the openings 400 in between the protrusions 250 of the canister 105.

In at least one example embodiment, the lid 115 may be coupled to the canister 105 by aligning the notches 825 of the lid 115 and the notches 405 of the canister 105 such that the protrusions 820 of the lid 115 may slide over the flange 410 and/or through the openings 400 of the canister 105, as shown in FIG. 10A. In such embodiments, the lid 115 may be placed on the canister 105 in the unlocked position (shown in FIG. 12) and rotated to the locked position (shown in FIG. 11). In at least one other example embodiment, the lid 115 may be coupled to the canister 105 when the lid is in any position. For example, the lid 115 may be placed on the canister 105 with the notches 825 of the lid 115 misaligned with the notches 405 of the canister 105 (such as in the locked position shown in FIG. 11). In such embodiments, the protrusions 820 of the lid 115 may be configured to move or slide over the protrusions 250 of the canister and engage the protrusions 250 to secure the lid 115 to the canister 105, such as in a snap-fit. In at least one example embodiment, a person may rotate the lid 115 from the locked position (shown in FIG. 11) to the unlocked position (shown in FIG. 12) by aligning the notches 825 with the notches 405. In such embodiments, the lid 115 may then be removed from the canister 105, as discussed above.

Figure 13:
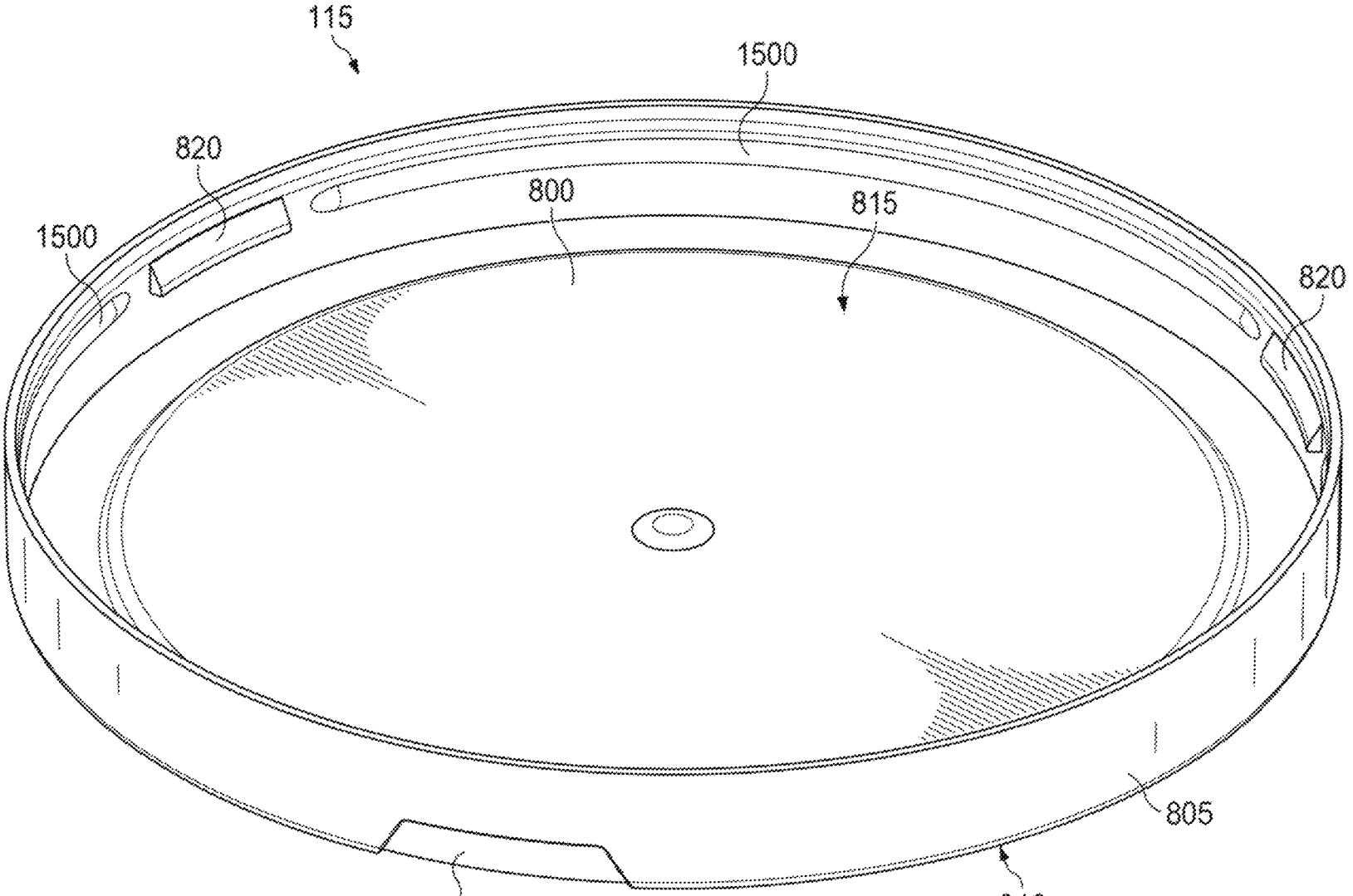
FIG. 13 is a bottom perspective view of the lid of FIGS. 1A-1B according to at least one example embodiment.

FIG. 13 is a bottom perspective view of the lid 115 of FIGS. 1A-1B according to at least one example embodiment.

The lid 115 of FIG. 13 is generally the same as the lid 115 of FIG. 8, except the lid 115 of FIG. 13 may include one or more beads 1500 extending from an interior surface of the peripheral wall 805, in at least one example embodiment. Each of the one or more beads 1500 may be positioned between each of the protrusions 820. In at least one example embodiment, when the peripheral wall 805 is cylindrical, the one or more beads 1500 may extend radially outward from at least a portion of the interior surface of the peripheral wall 805. The one or more beads 1500 may comprise a trapezoidal, circular, ovular, rectangular, or polygonal shape in cross-section.

In at least one example embodiment, the one or more beads 1500 may be configured to engage the protrusions 250 of the canister 105. For example, the one or more beads 1500 and/or the protrusions 820 of the lid 115 may be engaged with the protrusions 250 of the canister 105, such as in a snap-fit. In at least one example embodiment, the one or more beads 1500 prevent the lid 115 from coming off or falling off of the canister 105 when the lid 115 is in the unlocked position. For example, when the lid 115 is in the unlocked position (shown in FIG. 12), a person would have to pull or push the lid 115 upward with reference to FIG. 12 to disengage the one or more beads 1500 of the lid 115 from the protrusions 250 of the canister 105 and remove the lid 115 from the canister 105.

Figure 14:
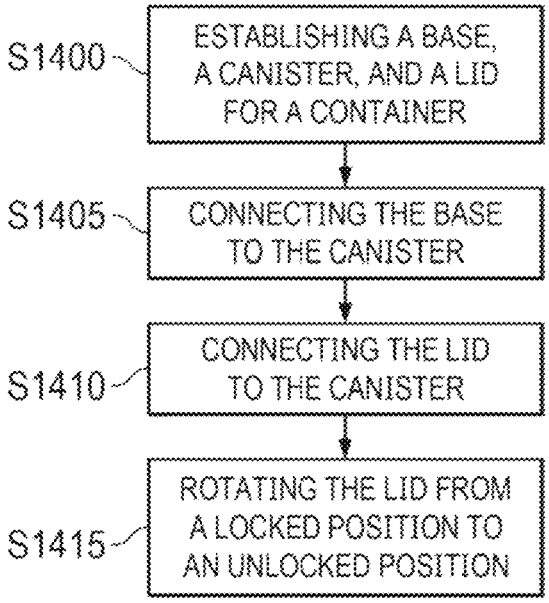
FIG. 14 is a flowchart depicting a method of using a container according to at least one example embodiment.

FIG. 14 is a flowchart depicting a method of using a container according to at least one example embodiment.

As shown in FIG. 14, in at least one example embodiment, the method generally includes establishing a base, a canister, and a lid for a container at step S1400, connecting the base to the canister at S1405, connecting the lid to the canister at S1410, and rotating the lid from a locked position to an unlocked position at S1415. Each of the steps is described in greater detail below.

At S1400, in at least one example embodiment, the method includes establishing a base, a canister, and a lid for a container. As described above in relation to FIGS. 2-4, the canister 105 may be established and include the base wall 200 having the first side 205 and the second side 210, the canister wall 215, and the sidewall 240. In at least one example embodiment, the canister wall 215 may extend about a periphery of the base wall 200. The canister wall 215 may include the first end 220 extending past the base wall 200 in a first direction and the second end 225 extending past the base wall 200 in a second direction. In such embodiments, the first side 2105 of the base wall 200 and the first end 220 of the canister wall 215 define the first cavity 230 and the second side 210 of the base wall 200 and the second end 225 of the canister wall 215 define the second cavity 235. In at least one example embodiment, the sidewall 240 extends from the second side 210 of the base wall 200 such that the sidewall 240, a portion of the second side 210 of the base wall 200, and the canister wall 214 define the gap 245.

As described above in relation to FIGS. 5-7, the base 110 may be established and include the bottom wall 500 having the top surface 505 and the bottom surface 510, the first sidewall 520 extending from a periphery of the bottom wall 500, the peripheral portion 515 extending from a bottom portion of the first sidewall 520, and a second sidewall 525 extending from an end of the peripheral portion 515. The first sidewall 520 and the second sidewall 525 may extend perpendicular to the peripheral portion 515 such that the peripheral portion 515, the first sidewall 520, and the second sidewall 525 define the gap 530.

As described above in relation to FIGS. 8-10 and 13, in at least one example embodiment, the lid 115 may be established and include the top wall 800 having the top surface 810 and the bottom surface 815 and the peripheral wall 805 extending from a periphery of the top wall 800.

At S1405, in at least one example embodiment, the method includes connecting the base 110 to the canister 105. The gap 245 of the canister 105 is configured to receive at least a portion of the first sidewall 520 of the base 110 and the gap 530 of the base 110 is configured to receive at least a portion of the canister wall 215 of the canister 105. In at least one example embodiment, the connecting the base 110 to the canister 105 includes engaging the protrusion 540 extending from an interior surface of the first sidewall 520 of the base 110 with the protrusion 300 extending from an exterior surface of the sidewall 240 of the canister 105.

In at least one example embodiment, the method includes connecting the lid 115 to the canister 105 at S1410. The lid 115 may be configured to rotate between a locked position and an unlocked position. In at least one example embodiment, the connecting the lid 115 to the canister 105 includes engaging the protrusion 250 extending from an exterior surface of the canister wall 215 and adjacent the first end 220 of the canister wall 215 with the one or more protrusion 820 extending from an interior surface of the peripheral wall 805 of the lid 115. In at least one example embodiment, the protrusion 250 of the canister 105 defines the openings 400 and the second end 225 of the canister wall defines the notches 405. The notches 405 may be aligned with the openings 400. In at least one example embodiment, the lid 115 defines the notches 825 extending from an exterior surface of the peripheral wall 805 to at least a portion of the top surface 810 of the top wall 800. The notches 825 may be configured to align with the one or more protrusions 820 of the lid 115.

At S1415, in at least one example embodiment, the method includes rotating the lid 115 from the locked position to the unlocked position. In the unlocked position, the lid 115 may be removed from the canister 105. In at least one example embodiment, the rotating the lid 115 from the locked position to the unlocked position includes aligning notches 825 of the lid 115 with the notches 405 of the canister 105. In at least one example embodiment, the method includes disengaging the one or more protrusions 820 of the lid 115 from the protrusion 250 of the canister 105 through the openings 400 such that the lid 115 may be removed from the canister 105 and the first cavity 230 may be exposed.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A container, comprising:

a base, the base including a bottom wall, a first sidewall extending from a top surface of the bottom wall, and a second sidewall extending from the top surface of the bottom wall, the second sidewall concentric with the first sidewall, the top surface of the bottom wall, the first sidewall, and the second sidewall define a first gap;

a canister configured to engage a portion of the base, the canister including, a base wall including a first side and a second side, a canister wall about a periphery of the base wall, the canister wall including a first end extending past the base wall in a first direction and a second end extending past the base wall in a second direction opposite the first direction, the first side of the base wall and the first end of the canister wall at least partially defining a first cavity, and the second side of the base wall and the second end of the canister wall at least partially defining a second cavity, and a third sidewall extending from the second side of the base wall and spaced apart from and concentric with the canister wall such that the third sidewall, a portion of the second side of the base wall, and the canister wall define a second gap, the second gap configured to receive at least a portion of the first sidewall of the base and the first gap configured to receive at least a portion of the second end of the canister wall; and a lid configured to be removably coupled to the canister such that the lid is moveable between a locked position and an unlocked position, the lid configured to interlock with the first end of the canister wall.

2. The container of claim 1, wherein the first sidewall and the second sidewall are perpendicular to the bottom wall.

3. The container of claim 1, wherein a length of the first sidewall is greater than a length of the second sidewall.

4. The container of claim 1, wherein a bottom surface of the bottom wall defines a recess.

5. The container of claim 1, wherein the base includes a first protrusion extending from an interior surface of the first sidewall; and the canister includes a second protrusion extending from an exterior surface of the third sidewall, the first protrusion configured to engage the second protrusion.

6. The container of claim 1, wherein a thickness of a top portion of the canister wall decreases from the second end toward the first end; and the canister wall includes a third protrusion extending from an exterior surface of the canister wall at the first end.

7. The container of claim 6, wherein the lid includes a top wall and a peripheral wall extending from the top wall, the lid includes at least one protrusion extending from an interior surface of the peripheral wall, the at least one protrusion of the lid configured to engage the third protrusion of the canister; and the lid defines at least one lid notch on an exterior surface of the peripheral wall and at least a portion of the top surface of the top wall, the at least one lid notch opposite the at least one protrusion on the interior surface of the lid.

8. The container of claim 7, wherein the third protrusion comprises a plurality of protrusions with an opening defined between each of the plurality of protrusions.

9. The container of claim 8, wherein the second end of the canister wall defines at least one canister notch, the at least one canister notch aligned with at least one opening defined between each of the plurality of protrusions.

10. The container of claim 9, wherein the at least one canister notch is configured to align with the at least one lid notch in the unlocked position.

11. The container of claim 7, wherein a center portion of the top surface of the top wall defines a recess.

12. The container of claim 1, wherein at least a portion of a periphery of the second end of the canister wall defines a recess, the recess configured to contact a top surface of the second sidewall of the base such that the second sidewall and the canister wall are flush when the canister and the base are engaged.

13. The container of claim 1, wherein the lid is configured to move from the locked position to the unlocked position, the lid configured to be removed from the canister in the unlocked position.

14. The container of claim 1, wherein:

the canister is configured to engage at least a portion of the base in a snap-fit; and the canister is configured to engage at least a portion of the lid in a snap-fit.

15. A method of using a container, comprising:

establishing a base, a canister, and a lid for the container, the base including, a bottom wall, a first sidewall extending from a top surface of the bottom wall, and a second sidewall extending from the top surface of the bottom wall, the second sidewall concentric with the first sidewall, the top surface of the bottom wall, the first sidewall, and the second sidewall defining a first gap;

the canister including, a base wall including a first side and a second side, a canister wall about a periphery of the base wall, the canister wall including a first end extending past the base wall in a first direction and a second end extending past the base wall in a second direction opposite the first direction, the first side of the base wall and the first end of the canister wall at least partially defining a first cavity and the second side of the base wall and the second end of the canister wall at least partially defining a second cavity, and a third sidewall extending from the second side of the base wall and spaced apart from the canister wall such that the third sidewall, a portion of the second side of the base wall, and the canister wall define a second gap, the lid including, a top wall including a top surface and a bottom surface, and a peripheral wall extending about a periphery of the top wall;

connecting the base to the canister such that the second gap receives at least a portion of the first sidewall and the first gap receives at least a portion of the canister wall;

connecting the lid to the canister; and rotating the lid from a locked position to an unlocked position such that the lid is removable from the canister.

16. The method of claim 15, wherein the connecting the base to the canister comprises:

engaging a first protrusion extending from an interior surface of the first sidewall of the base with a second protrusion extending from an exterior surface of the third sidewall of the canister.

17. The method of claim 15, wherein the connecting the lid to the canister comprises:

engaging a third protrusion extending from an exterior surface of the canister wall and adjacent the first end of the canister wall with at least one protrusion extending from an interior surface of the peripheral wall of the lid.

18. The method of claim 17, wherein the third protrusion defines at least one opening;

the second end of the canister wall defines at least one canister notch, the at least one canister notch aligned with the at least one opening; and the lid defines at least one lid notch on an exterior surface of the peripheral wall and at least a portion of the top surface of the top wall, the at least one lid notch opposite the at least one protrusion on the interior surface of the lid.

19. The method of claim 18, wherein the rotating the lid from the locked position to the unlocked position includes aligning the at least one lid notch with the at least one canister notch.

20. The method of claim 19, further comprising:

disengaging the at least one protrusion of the lid from the third protrusion of the canister through the at least one opening such that the lid is removed from the canister and the first cavity is exposed.

* * * * *